US008764251B2

(12) United States Patent
Lien

(10) Patent No.: US 8,764,251 B2
(45) Date of Patent: Jul. 1, 2014

(54) HEAT DISSIPATION STRUCTURE FOR LIGHT BULB ASSEMBLY

(75) Inventor: Chen-Chun Lien, New Taipei (TW)

(73) Assignee: Everspring Industry Co., Ltd., New Taipei (TW)

( * ) Notice: Subject to any disclaimer, the term of this patent is extended or adjusted under 35 U.S.C. 154(b) by 155 days.

(21) Appl. No.: 13/462,436

(22) Filed: May 2, 2012

(65) Prior Publication Data

US 2013/0292106 A1 Nov. 7, 2013

(51) Int. Cl.

| | |
|---|---|
| ***F21V 29/00*** | (2006.01) |
| ***H01J 7/24*** | (2006.01) |
| *F21K 99/00* | (2010.01) |
| *F21Y 101/02* | (2006.01) |

(52) U.S. Cl.

CPC ..... *F21V 29/2231* (2013.01); *F21K 9/13* (2013.01); *F21Y 2101/02* (2013.01)

USPC ..... 362/373; 313/46

(58) Field of Classification Search

CPC ..... F21K 9/00; F21K 9/10; F21K 9/13; F21K 9/135; F21K 9/1355; F21Y 2111/001; F21Y 2101/02; F21V 29/00; F21V 29/002; F21V 29/004; F21V 29/22; F21V 29/2206; F21V 29/2212; F21V 29/2218; F21V 29/2225; F21V 29/2231; F28F 7/00

USPC ..... 362/294, 373; 313/45, 46

See application file for complete search history.

(56) References Cited

U.S. PATENT DOCUMENTS

| | | | | |
|---|---|---|---|---|
| 7,871,184 | B2 * | 1/2011 | Peng | 362/294 |
| 8,157,422 | B2 * | 4/2012 | Paik et al. | 362/294 |
| 8,283,844 | B2 * | 10/2012 | Cho et al. | 313/113 |
| 8,523,395 | B2 * | 9/2013 | Igaki et al. | 362/373 |

FOREIGN PATENT DOCUMENTS

| | | |
|---|---|---|
| TW | M343768 | 11/2008 |

* cited by examiner

*Primary Examiner* — Alan Cariaso

(74) *Attorney, Agent, or Firm* — Muncy, Geissler, Olds & Lowe, P.C.

(57) ABSTRACT

A heat dissipation structure for a light bulb assembly includes a holder, a heat dissipating cover, and a light seat. The holder includes a socket and a receiving space defined in the socket to receive a circuit board, the socket includes a first abutting portion formed on a peripheral side thereof and at least one first coupling portion arranged on a lateral side thereof. The heat dissipating cover includes a through hole for inserting the socket, and at least one cooling fin arranged around an outer peripheral side thereof. The light seat is used for installing a LED light, which includes a second coupling portion connected with the at least one first coupling portion, and a second abutting portion retaining the heat dissipating cover with the first abutting portion.

8 Claims, 3 Drawing Sheets

HEAT DISSIPATION STRUCTURE FOR LIGHT BULB ASSEMBLY

FIELD OF THE INVENTION

The present invention relates to a heat dissipation structure for a bulb, and more particularly to a heat dissipation structure for a light bulb assembly which is capable of assembling the light bulb tightly without using screws.

BACKGROUND OF THE INVENTION

A conventional bulb emits light by ways of tungsten wires, so it has a simple structure and is replaced easily. An incandescent light bulb contains a spherical lampshade and a connector disposed on a distal end of the lampshade, the connector has threads to screw with a holder. When transmitting a power source, the tungsten wires in the lampshade emit heat and light, and the light penetrates the lampshade to make an illumination. However, during an operation of the incandescent light bulb, a lot of heat will generate, thus having a great power and energy consumption and a short service life.

A light emitting diode (LED) is a solid light source used to transform electricity energy into light energy, so it is made of semiconductor materials in the epitaxial growth technology. The light emitting diode (LED) has some features, such as a small size, a low driving voltage, a quick reaction rate, a shake proof function, a long service life, and environmental protection. With technology development and improvement, a luminous efficiency of the light emitting diode (LED) since 1960 is enhanced constantly to exceed that of the incandescent light bulb (its efficiency is around 10-20 lm/W) and that of a fluorescent lamp (its efficiency is around 60-80 lm/W).

Because of a constant development of LED related technology, the luminous efficiency of LED is expected to reach 100 lm in recent years. Since the LED has become the most remarkable spotlight in a new generation of solid light source, and electronic elements are produced in thin and light-weight type, so the light emitting diode (LED) will replace the incandescent light bulb to become a widely used illumination device. Likewise, thanks to signal lights, street lamps, home lighting, lights, and advertising lights are used commonly, LED are a mainstream product in lighting market.

Nevertheless, if the light emitting diode (LED) has more power and larger brightness or its module generates larger heat, its heat is difficult to dissipate. Therefore, the heat dissipation is a technological bottleneck for the light emitting diode (LED). A heat dissipation solution to the light is to provide a radiator to dissipate heat in the air by contacting a surface of the radiator with convection air. Therefore, the radiator with a large cooling area has to be fixed in the light emitting diode (LED) with high power and brightness so as to prevent form a light fade. But such a light emitting diode (LED) has a large size that will occupy space.

To overcome above-mentioned heat dissipation, a heat dissipation structure for a LED light is disclosed in TW Publication No. M343768. The heat dissipation structure contains a positioning rib formed around a peripheral side of a hole of a housing, and the positioning rib has an orifice, two sides of which contact with a first coupling plate and a second coupling plate individually. The first coupling plate is provided to fix a control chip, and the second coupling plate is provided to position a LED light, a heat conducting fluid or heat sink compounds are fed into the orifice, and the two sides of the orifice are closed by the first coupling plate and the second coupling plate respectively. Thereby, a contacting area of heat dispersion is enhanced to increase a heat dispersing effect.

However, the housing, the first coupling plate, and the second coupling plate are connected together by ways of screws and screw holes, so in the manufacture process, a step for forming the screw holes has to be executed after a die sinking. Besides, a crack of the housing will occur because of an improper force during the screws are inserted to the screw holes.

The present invention has arisen to mitigate and/or obviate the afore-described disadvantages.

SUMMARY OF THE INVENTION

The primary object of the present invention is to provide a heat dissipation structure for a light bulb assembly in which each component is only produced by ways of one-time die sinking to save a process for forming screw holes.

To obtain the above objectives, a heat dissipation structure for a light bulb assembly provided by the present invention includes: a holder, a heat dissipating cover, and a light seat. The holder includes a socket and a receiving space defined within the socket to receive a circuit board, and the socket includes a first abutting portion formed on a peripheral side thereof and at least one first coupling portion arranged on a lateral thereof. The heat dissipating cover includes a through hole for inserting the socket, a rim around the trough hole abutting against the first abutting portion, and at least one cooling fin arranged around an outer peripheral side thereof. The light seat is used for installing a LED light which is electrically connected to the circuit board. The light seat includes a second coupling portion connected with the at least one first coupling portion, and a second abutting portion retaining the heat dissipating cover with the first abutting portion. Thus, the holder, the heat dissipating cover, and the light seat are connected together.

Further, the heat dissipating cover includes a heat dispersing portion fitted on the socket and an aluminum plate mounted on one end of the heat dispersing portion which corresponds to the second abutting portion.

Further, the light seat includes a first positioning portion, and the aluminum plate includes a second positioning portion positioning the first positioning portion.

Further, the heat dissipation structure for the light bulb assembly includes a lampshade engaged with the heat dissipating cover to receive the light seat.

Further, the lampshade includes an orifice for the LED light to extend outward therefrom.

Further, the at least one first coupling portion is a retaining recess, and the second coupling portion is a hook retained with the retaining recess.

Further, the holder includes a metal connector connected with an external power source to supply a power to the circuit board.

Further, the LED light includes a first engaging portion, and the light seat includes a second engaging portion engaging with the first engaging portion.

Thereby, the heat dissipating cover is fitted on the socket of the holder, and the light seat is fixed on the socket so that the heat dissipating cover are retained between the first abutting portion of the socket and the second abutting portion of the light seat. Thus, all components of the heat dissipation structure for the light bulb assembly are connected together securely. Hence, each component of the heat dissipation structure is only produced by ways of one-time die sinking to save a process for forming screw holes. On the other hand, a positioning process of screws and screw holes is eliminated during manufacture, thus preventing from a crack in the assembly.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
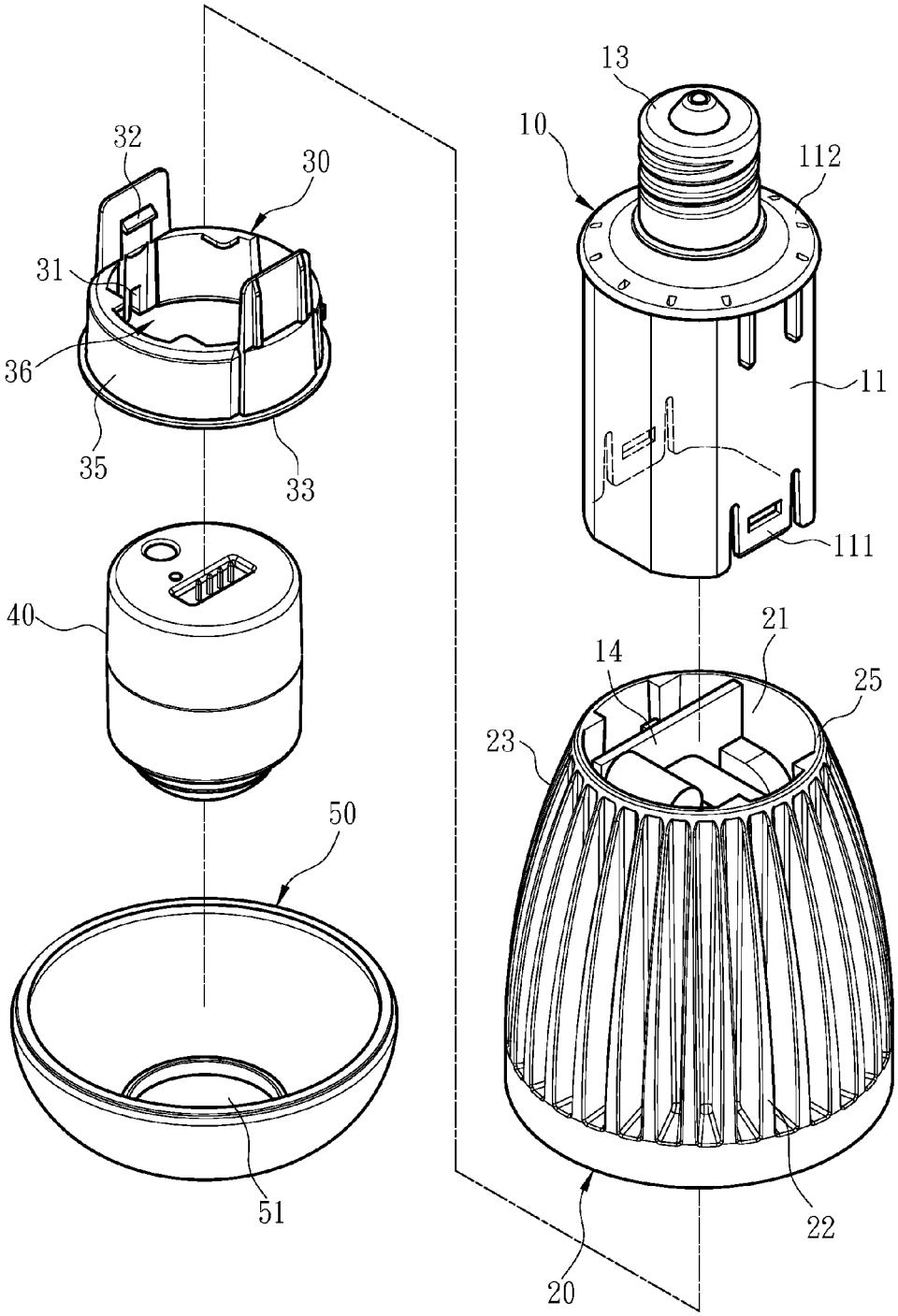
FIG. 1 is a perspective view showing the exploded components of a heat dissipation structure for a light bulb assembly according to the present invention.
Figure 2:
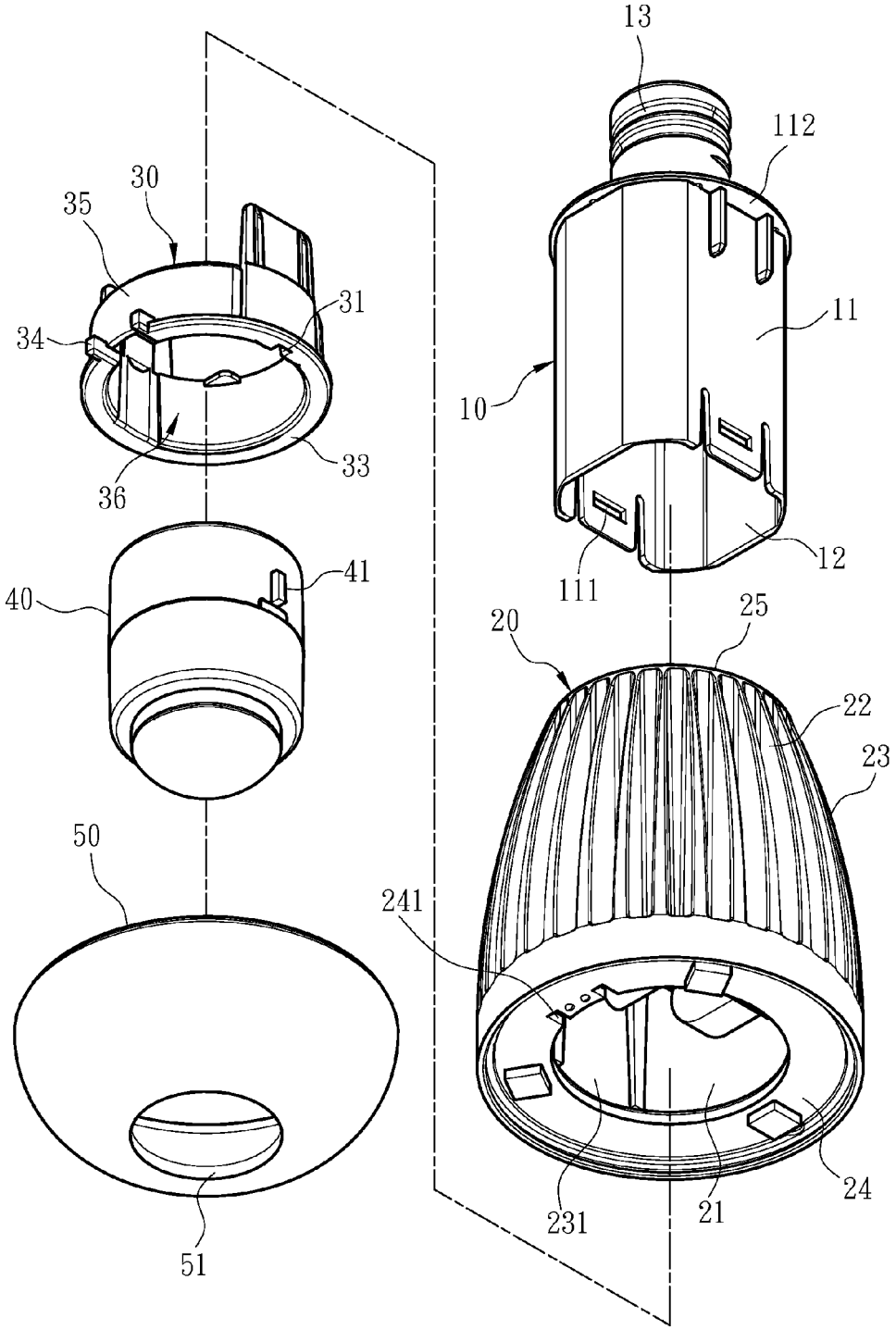
FIG. 2 is another perspective view showing the exploded components of the heat dissipation structure for the light bulb assembly according to the present invention.

FIGS. 1 and 2 are a perspective view showing the exploded components of a heat dissipation structure for a light bulb assembly according to the present invention. As shown in FIGS. 1 and 2, the heat dissipation structure for the light bulb assembly of the present invention comprises a holder 10, a heat dissipating cover 20 fitted on an outer peripheral side of the holder 10, and a light seat 30 connected to the holder 10. The holder 10 includes a metal connector 13 (i.e., a main connector) electrically connected thereon to obtain an external power, a socket 11 connected with the metal connector 13, and a receiving space 12 defined in the socket 11 to receive a circuit board 14. One end of the socket 11 is connected with the light seat 30, and the light seat 30 is used for installing a LED light 40. The LED light 40 is electrically connected to the circuit board 14. Thereby, the LED light 40 allows to obtain an external power source processed by the circuit board 14.

The assembly of the heat dissipation structure for the light bulb assembly of the present invention is described in details as follows:

The socket 11 includes a first abutting portion 112 formed on a peripheral side thereof adjacent to the metal connector 13 and at least one first coupling portion 111 arranged on a lateral side thereof. The heat dissipating cover 20 includes a through hole 21 for inserting the socket 11 and matching with a shape of the socket 11. As the heat dissipating cover 20 is connected to the socket 11, the first abutting portion 112 of the socket 11 abuts against a rim 25 at one end of the heat dissipating cover 20 which is around the through hole 21. The light seat 30 includes a second coupling portion 32 connected with the at least one first coupling portion 111 and a second abutting portion 33 formed on the light seat 30 to abut against an inner side of another end 26 of the heat dissipating cover 20 opposite to the first abutting portion 112. The light seat 30 also includes an outer wall 35 and a holding space 36.

Figure 3:
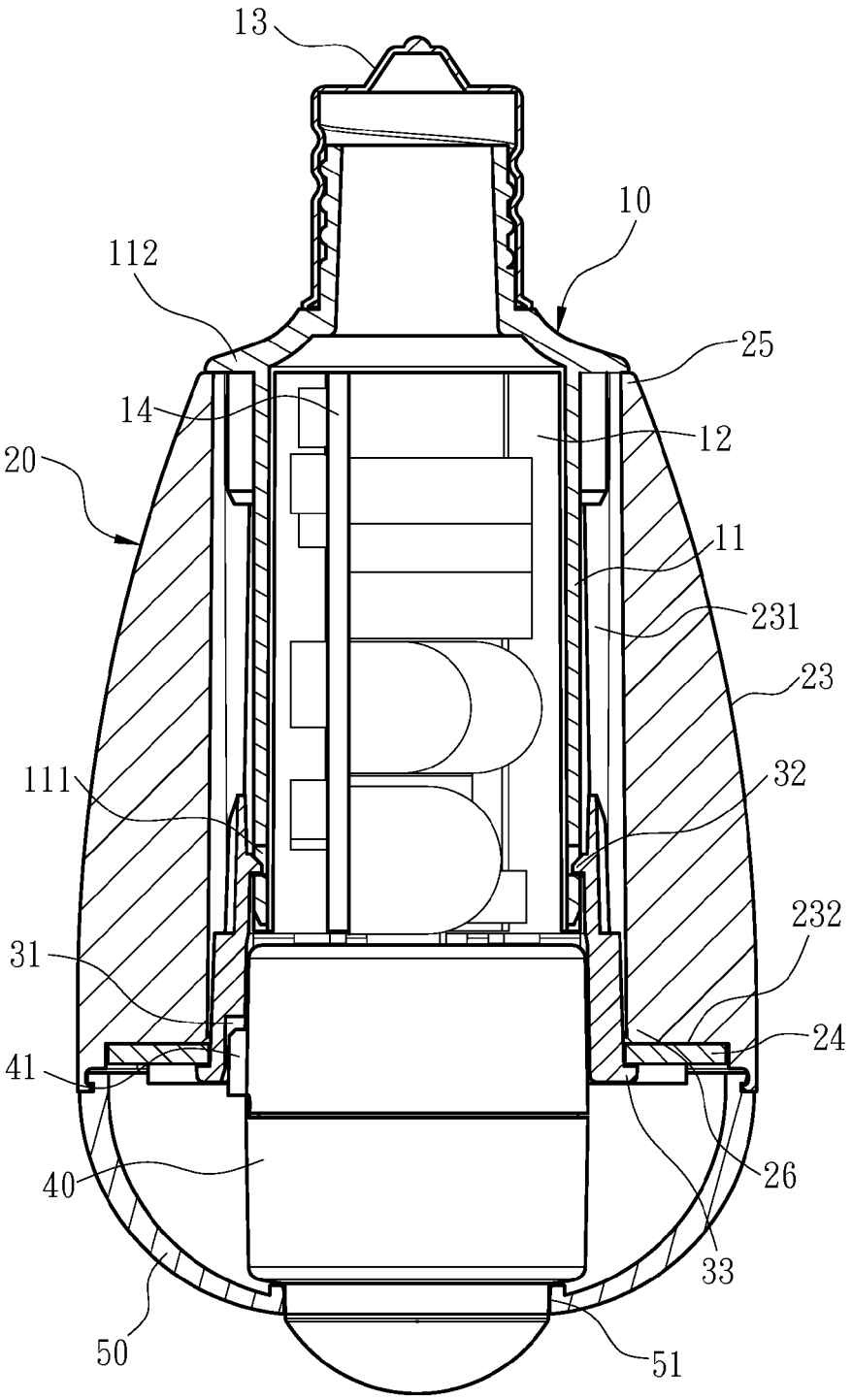
FIG. 3 is a cross sectional view showing the assembly of the exploded components of the heat dissipation structure for the light bulb assembly according to the present invention.

Referring further to FIG. 3, the at least one first coupling portion 111 of the socket 11 is a retaining recess, and the second coupling portion 32 is a hook retained with the retaining recess. The heat dissipating cover 20 includes a heat dispersing portion 23 fitted on the socket 11 and an aluminum plate 24 mounted on one end of the heat dispersing portion 23 which corresponds to the second abutting portion 33 of the light seat 30, the heat dispersing portion 23 includes a slot 232 arranged thereon to receive the aluminum plate 24. To permit an entry room forming when the second coupling portion 32 and the at least one first coupling portion 111 are connected together, the heat dispersing portion 23 includes two guiding notches 231 arranged on two inner sides of the through hole 21 to guide the second coupling portion 32 inward. In addition, the aluminum plate 24 includes a second positioning portion 241 defined thereon adjacent to an outer rim of one end of the light seat 30, and the light seat 30 includes a first positioning portion 34 extending outward from the second abutting portion 33 to engage with the second positioning portion 241. Thus, the light seat 30 is fixed on the heat dissipating cover 20, and the light seat 30 and the socket 11 do not move relative to the heat dissipating cover 20.

To increase a dissipating area of the heat dissipating cover 20, the heat dissipating cover 20 further includes a plurality of cooling fins 22 arranged around an outer peripheral side thereof so that the LED light 40 accelerates a heat dissipation through the heat dissipating cover 20 to lower a temperature of the LED light 40. The heat dissipation structure for the light bulb assembly of the present invention further comprises a lampshade 50 screwed with the heat dissipating cover 20 to receive the light seat 30, and the lampshade 50 includes an orifice 51 for the LED light 40 to extend outward therefrom, an inner side of the lampshade 50 proximate to the orifice 51 is biased against an upper surface of the LED light 40 so that the LED light 40 is fixed on the light seat 30. To avoid a shake of the LED light 40 relative to the light seat 30, on the other hand, the LED light 40 also includes a first engaging portion 41, and the light seat 30 includes a second engaging portion 31 corresponding to and engaging with the first engaging portion 41, such that the LED light 40 is fixed on the light seat 30.

As illustrated in FIGS. 1-3, in which FIG. 3 is a cross sectional view showing the assembly of the heat dissipation structure for the light bulb assembly according to the present invention. In the assembly, the socket 11 of the holder 10 is secured in the heat dissipating cover 20 via the through hole 21 of the heat dissipating cover 20, and the first abutting portion 112 of the socket 11 abutting one end of the heat dissipating cover 20. The light seat 30 is connected with the at least one first coupling portion 111 of the socket 11 via the second coupling portion 32, during which the first abutting portion 112 of the socket 11 and a second abutting portion 33 of the light seat 30 are guided to contact with the second positioning portion 241 and the aluminum plate 24 respectively so that the heat dissipating cover 20, the light seat 30, and the holder 10 are connected together tightly.

Thereby, the heat dissipating cover is fitted on the socket of the holder, and the light seat is fixed on the socket so that the heat dissipating cover are retained through the first abutting portion of the socket and the second abutting portion of the light seat so that all components of the heat dissipation structure for the light bulb assembly are connected together securely. Hence, each component of the heat dissipation structure is only produced by ways of one-time die sinking to save a process for forming screw holes. On the other hand, a positioning process of screws and screw holes is eliminated during manufacture, thus preventing from a crack in the assembly. Furthermore, the aluminum plate transmits heat to the heat dispersing portion and provides an insulation effect simultaneously.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A heat dissipation structure for a light bulb assembly comprising:

a holder including a socket and a receiving space defined within the socket to receive a circuit board, the socket including a first abutting portion formed on a peripheral side thereof and at least one first coupling portion arranged on a lateral side thereof;

a heat dissipating cover including a first end abutted by the first abutting portion, a second end opposite to the first end, a through hole communicating the first end with the second end for the socket to penetrate through, and at least one cooling fin arranged around an outer peripheral side thereof; and a light seat including an outer wall penetrating into the through hole of the heat dissipating cover, a holding space defined within the outer wall for installing an LED light which is electrically connected to the circuit board, a second abutting portion formed on a peripheral side thereof and abutted by the second end of the heat dissipating cover, and at least one second coupling portion extended from the outer wall to insert into the through hole and couple with the at least one first coupling portion so that the holder, the heat dissipating cover, and the light seat are tightly coupled together.

2. The heat dissipation structure for the light bulb assembly of claim 1, wherein the heat dissipating cover includes a heat dispersing portion fitted on the socket and an aluminum plate mounted on the second end of the heat dispersing portion.

3. The heat dissipation structure for the light bulb assembly of claim 2, wherein the light seat includes a first positioning portion, and the aluminum plate includes a second positioning portion positioning the first positioning portion.

4. The heat dissipation structure for the light bulb assembly of claim 1, wherein further comprising a lampshade engaged with the heat dissipating cover to receive the light seat.

5. The heat dissipation structure for the light bulb assembly of claim 4, wherein the lampshade includes an orifice for the LED light to extend outward therefrom.

6. The heat dissipation structure for the light bulb assembly of claim 1, wherein the at least one first coupling portion is a retaining recess, and the second coupling portion is a hook retained with the retaining recess.

7. The heat dissipation structure for the light bulb assembly of claim 1, wherein the holder includes a metal connector connected with an external power source to supply a power to the circuit board.

8. The heat dissipation structure for the light bulb assembly of claim 1, wherein the LED light includes a first engaging portion, and the light seat includes a second engaging portion engaging with the first engaging portion.

* * * * *